US005676886A

United States Patent [19]

Fleming

[11] Patent Number: 5,676,886

[45] Date of Patent: Oct. 14, 1997

[54] LOW LYING FOG SIMULATOR AND METHOD

[75] Inventor: Richard N. Fleming, Apollo Beach, Fla.

[73] Assignee: Sigma Services, Inc., Plant City, Fla.

[21] Appl. No.: 722,350

[22] Filed: Sep. 27, 1996

[51] Int. Cl.[6] ..... B01F 3/04

[52] U.S. Cl. ..... 261/16; 446/24; 55/DIG. 15

[58] Field of Search ..... 261/16; 446/24, 446/25; 55/DIG. 15

[56] References Cited

U.S. PATENT DOCUMENTS

| | | | |
|---|---|---|---|
| 1,683,760 | 9/1928 | Conners | 446/24 |
| 3,081,068 | 3/1963 | Milleron | 55/DIG. 15 |
| 3,188,785 | 6/1965 | Butler | 55/DIG. 15 |
| 3,689,237 | 9/1972 | Stark et al. | 261/16 |
| 3,771,260 | 11/1973 | Arenson | 261/16 |
| 4,303,397 | 12/1981 | Swiatosz | 446/24 |
| 4,764,660 | 8/1988 | Swiatonsz | 261/142 |
| 4,911,866 | 3/1990 | Monroe | 261/81 |
| 4,990,290 | 2/1991 | Gill et al. | 261/30 |

*Primary Examiner*—Tim R. Miles
*Attorney, Agent, or Firm*—Quarles & Brady

[57] ABSTRACT

A low lying fog simulator including a liquid carbon dioxide source and a cooler to be used with a smoke generating machine. The liquid carbon dioxide is forced through an expansion valve to provide a cold carbon dioxide gas pocket through which the smoke passes prior to being dispersed into the ambient. When dispersed into the ambient the cold smoke/carbon dioxide mixture falls toward a level near the earth's surface simulating a low lying fog.

21 Claims, 6 Drawing Sheets

LOW LYING FOG SIMULATOR AND METHOD

FIELD OF THE INVENTION

The present invention relates to a method and apparatus for controllably simulating fog and more particularly to a method and apparatus for simulating a long lasting low lying fog.

BACKGROUND OF THE INVENTION

Many theme parks, theatrical groups and musical performers have taken advantage of special effects machines to enhance their presentations by simulating various weather conditions. One particularly desirable simulated weather condition is low lying fog which is fog that seems to crawl along the floor as it spreads. When realistically simulated, low lying fog can enhance scary, romantic, festive and dramatic performances as well as other performance types without appreciably obstructing an audiences ability to enjoy the visual aspects of the performance. Even when a thick low lying fog is generated, the visual aspects of a performance above the fog are easily observed.

Generally, there are two types of fog simulating machines, machines which actually produce a water based fog and machines which produce a fog-like smoke. Machines which actually produce a water based fog create low lying fog by dropping bits of solid carbon dioxide into hot water within a vessel having an outlet. Some of the hot water expands in and maintains a high humidity within the vessel. When the solid carbon dioxide is dropped into the hot water, the carbon dioxide expands into gaseous cold carbon dioxide rising and increasing the pressure within the vessel. When the cold carbon dioxide gas and water intermix, the humidity is condensed into water droplets which are observable as fog. The pressure caused by the expanding carbon dioxide forces the cold water droplets out the outlet and into the ambient. Typically, a fan will be provided adjacent the outlet to transport the water droplets away from the outlet for use on a stage or the like. With this method, the low lying fog produced consists of a visible aggregate of minute droplets of very cold water suspended within the earth's atmosphere.

As well known in the sciences generally, when two adjacent gaseous volumes are at appreciably different temperatures, the hot volume will rise and displace the cold volume thus causing a hot thermal updraft and a corresponding cold thermal down draft. Where small particles (e.g. water droplets, dust, . . . ) are present in the hot or cold volumes the particles will be entrained in the updraft or down draft and will assume either a high level (e.g., if in the hot volume) or a relatively lower level (e.g., if in the cold volume).

With water based fog generated as described above, when the fog is dispersed into an environment having a typical ambient temperature (e.g. 50–90 degrees F.), the cold air surrounding the water droplets forms a thermal cold air down draft and forces the droplets to a level near the earth's surface where the droplets hover for a time and are observable, as intended, as low lying fog.

Thus, because of the effects of the thermal drafts, the height of a water based fog depends primarily on the temperature of the environment into which the fog is dispersed and the temperature of the air surrounding the cold water droplets when the droplets are dispersed into the ambient.

While water based fog can be used to generate a realistic low lying fog, water based fog is disadvantageous for a number of reasons. Most importantly, in some environments water droplets will remain in a state observable as fog for only a short period. The duration of a water based fog depends primarily on the humidity of the environment into which the fog is dispersed. Where two adjacent volumes are at appreciably different humidity levels, the more humid volume will evaporate into the relatively less humid volume such that eventually the two volumes will have a common humidity level. Because water based fog has a relatively high humidity level, water based fog is only effective in relatively high humidity environments (e.g. 70–100% humidity). Where water based fog is dispersed into a dry environment, water droplets quickly evaporate into the ambient and the fog effect ends.

In addition to humidity, the duration of water based fog is effected by the temperature of the environment into which the fog is dispersed. Because water based fog consists of cold water droplets surrounded by cold air, after water based fog is dispersed into an environment where the temperature is within a typical range (e.g., 50°–90° F.), water droplet temperatures increase rapidly. When the temperatures increase the rate of water droplet evaporation increases thus reducing the length of time over which the water droplets are observable as fog.

Thus, to provide long lasting fog in an environment having a typical ambient temperature (e.g. 50°–90° F.) and/or a low humidity level, a fog machine must continually generate fog to replace evaporated droplets. For this reason, it is relatively expensive to use fog machines to provide long periods of fog.

Another problem with water based fog machines is that fog cannot be easily transported away from the fog machine for use in remote areas. As discussed above, after fog is generated, droplets evaporate rapidly in warm and/or dry environments and the fog effect can terminate relatively quickly. While thermally insulated transport tubes can increase the distance over which fog can be transported, in warm environments transport tubes are only effective over short distances. In addition, insulated tubes are relatively expensive and, when fog is released from an insulated transport tube, the fog still evaporates quickly in warm and/or dry environments.

One way to prolong the period over which water will remain in a state observable as fog is to cool the environment into which the fog is dispersed and, where the environment is relatively dry, increase the environment's humidity.

Unfortunately, this solution can be relatively expensive as huge cooling and humidifying systems may be required to achieve suitable temperature and humidity levels. This is particularly true where a performance takes place in a large auditorium or the like. In addition, this solution can make performers and an audience uncomfortable as the temperature required to appreciably increase the duration of the fog is irritatingly low.

Moreover, as the temperature of the environment is decreased, the temperature difference between the generated fog and the environment is reduced which in turn diminishes the strength of the thermal cold draft which entrains the water droplets and forces them to a level near the earth's surface. The end result is that the "low lying" fog effect may be lessened.

Smoke machines overcome some of the problems associated with fog machines. Typically, smoke machines create smoke by heating a smoke generating fluid (e.g. oil) to a temperature just below the temperature at which the fluid will ignite (e.g. 250–400 degrees F.). Then, the hot fluid is forced through one or more small orifices (e.g. 20–30 thousandths of an inch) into an expansion chamber wherein the hot fluid expands generating smoke molecules observable as smoke.

Once formed smoke molecules do not melt or evaporate as their temperatures fluctuate within a typical ambient temperature range (e.g. 50°–90° F.). From a distance, smoke molecules have an appearance which is nearly identical to the appearance of water based fog. In addition, smoke molecules are relatively light weight so that they can, like Water droplets generated by fog machines, remain suspended within the earth's atmosphere for some time. Because smoke molecules do not melt or evaporate and are light weight, the fog-like effect generated using a smoke machine lasts for a relatively long period.

In addition, because smoke molecules do not evaporate, smoke can be transported from a smoke generating machine to a remote area using a relatively inexpensive uninsulated transport tube.

While smoke machines can simulate fog for a relatively long period, because of the heat required to generate smoke, smoke tends to rise when dispersed into an environment having a typical ambient temperature. In other words, because smoke molecules are light weight and are generated using heat, when the smoke molecules and hot air that surrounds the molecules is dispersed into the ambient, the hot air causes a thermal hot air updraft which entrains the smoke molecules and carries them upward. As the smoke molecules rise and the hot air cools, the initially hot air eventually reaches an equilibrium temperature equal to the ambient temperature and the smoke molecules reach an equilibrium height at which they form a noticeable simulated fog smoke layer. Unfortunately, in most cases the equilibrium height of the fog-like smoke layer is too high to be useful in simulating low lying fog.

Moreover, depending on the ambient temperature and the temperature of the hot air as it is dispersed into the ambient, the resulting smoke layer may settle at an equilibrium height that is approximately head level. In this case, in addition to impeding observation of a performance, the smoke layer may also interfere with actors or musicians performing as they attempt to breath air within the smoke layer.

Thus, it would be advantageous to have an apparatus and method capable of simulating fog wherein the fog simulated is relatively long lasting and low lying.

SUMMARY OF THE INVENTION

The present invention includes both a method and an apparatus which can be used to simulate a relatively long lasting low lying fog. To this end, the invention provides an extremely cold smoke which migrates toward the earth's surface after it is dispersed into the ambient. In addition, preferably, the smoke used with the present invention includes molecules which are structurally and magnetically alterable during the cooling process such that the smoke molecules dispersed into the environment are magnetically attracted to the earth's surface and are relatively heavier, thus experiencing relatively greater gravitational pull. Thus, with the present invention, preferably three separate forces, magnetic attraction, gravity and a thermal draft, all combine to force smoke toward the earth's surface and simulate low lying fog.

The inventive apparatus is to be used with a smoke generating machine and forms an internal chamber and includes a source that provides liquid carbon dioxide that, when expanded into a gas using a venturi, provides a cold carbon dioxide gas to the chamber forming a cold gas pocket through which smoke entering the chamber passes prior to passing through the outlet, the smoke temperature decreasing as the smoke passes through the gas pocket. Preferably the invention cools smoke molecules to temperatures below 0 degrees F., more preferably below −10 degrees F. and most preferably below −25 degrees F. These temperatures can be achieved using liquid carbon dioxide as the cooling mechanism.

Thus, one object of the invention is to simulate a long lasting fog. In this regard, the present invention takes advantage of the fact that smoke molecules remain intact (i.e. the molecule does not melt or evaporate) after the molecules are dispersed into an environment having a temperature within a typical ambient range.

Another object of the invention is to simulate a low lying fog. By cooling smoke molecules prior to dispensing the molecules into the ambient, the present invention eliminates the thermal hot air updraft associated with the heat required to initially create the smoke molecules. In fact, the present invention generates smoke molecules that are surrounded by cold air (e.g., −25° to −50° F.) and which, therefore, become entrained in a cold air down draft and settle at a level near the earth's surface.

Preferably, the smoke fluid used with the present invention provides smoke molecules that include electrons which are slowed appreciably when the molecules are cooled to below 0 degrees F. so that the magnetic moments associated with the molecules can be aligned with the earth's magnetic field, thus increasing the degree with which the smoke molecules are attracted toward the earth's surface. A preferred fluid used to generate smoke according to the present invention is the fluid distributed by LeMaitre Special Effects of 546 Soleveign Road London, Ontario N5V4K5 under the trademark LSX fluid.

In keeping with the object of simulating a low lying fog, it is believed that where certain types of smoke are used with the inventive apparatus, when the smoke is cooled, the smoke molecules become relatively more attracted to the earth's surface. As well known in the sciences, the earth has a magnetic field of its own which can attract or repel an object that itself is characterized by a magnetic moment. For example, the earth's north pole attracts a magnet's south pole while the earth's south pole attracts a magnet's north pole such that a magnet will tend to align with its south pole directed toward the earth's north pole. This same phenomenon can be observed with an electromagnet formed from a coil wrapped around a nail. In this case, when a current (i.e. electrons) is passed through the coil, magnetic flux causes a magnetic field inside the nail and causes north and south poles to be formed according to the right hand rule. Here, as with a naturally occurring magnet, the magnet's north pole is attracted to the earth's south pole and the magnet's south pole is attracted to the earth's north pole.

A smoke molecule includes a plurality of atoms and each atom includes a number of electrons which travel around the nucleus of the atom. A single electron orbiting around a nucleus acts as an electric current and produces a field just like the current passing through the coil of an electromagnet. When a molecule is extremely hot, the electrons therein have high kinetic energies and move at a relatively high speed, colliding and changing directions quickly and generally randomly. While the electrons are always within the earth's magnetic field, the electron speeds are so great that the electron orbits are relatively unaffected by the earth's magnetic field, the random atomic fields generated by the electrons tend to cancel and the resulting molecular magnetic moment is relatively weak. In this case, because the molecule's magnetic moment is weak, the molecule exhibits little magnetic attraction to the earth.

However, it is believed that when certain types of smoke molecules are cooled sufficiently (e.g. below 0 degrees F. and preferably below −10 degrees F.), the electrons inside the molecules slow down to the point where their orbits are affected by the earth's magnetic moment. In effect, it is believed that when the electrons are slowed, under force of the earth's magnetic field, the electrons' orbits are substantially (although not entirely) aligned such that the electrons orbit in a manner which forms a slight north-south dipole within the molecule which is aligned with the earth's magnetic field (i.e. the molecules south pole is attracted to the earth's north pole). After the magnetic dipole is formed the molecule is magnetically attracted toward the earth's surface thus causing the molecule to tend downwardly enhancing the low lying effect.

Preferably the smoke used with the present invention includes molecules that are characterized by an initial molecular mass which is increased as the molecules pass through the gas pocket such that the smoke molecules dispersed into the ambient are relatively heavy.

In keeping with the object of simulating a low lying fog, by providing relatively heavy smoke molecules the generated smoke tends toward the earth's surface more readily under the force of gravity. It is believed that where certain types of smoke are cooled using gaseous carbon dioxide, the gaseous carbon dioxide interacts with the smoke molecules and increases their molecular mass. More specifically, it is believed that when certain smoke molecules are cooled using a carbon dioxide gas, the gas and molecules react and the smoke molecule's mass is increased by the addition of at least one, and possibly a plurality, of carbon atoms. A preferred fluid for generating smoke molecules having these characteristics is the fluid distributed under the trademark LSX by LeMaitre Special Effects which is identified in more detail above.

In keeping with the object of providing a long lasting fog effect, the heavy smoke molecules enable the fog-like effect to continue even after the temperature of the air around the smoke molecules rises to the ambient temperature. Immediately after smoke is dispersed into the warm ambient, the molecule temperatures begin to rise and approach the ambient temperature. Eventually, the smoke molecules reach the ambient temperature and the cold air down draft is terminated and is no longer effective to maintain the smoke molecules near the earth's surface. In addition, it is believed that when the smoke molecules warm, their electron speeds increase, the electron's overcome the effect of the earth's magnetic field, the electron magnetic fields become misaligned and again tend to cancel thus reducing the magnetic attraction between the earth and the molecule. When the smoke molecule temperatures reach the ambient temperature, light smoke molecules may rise under the influence of local thermal updrafts into the ambient and produce an unintended smoke haze. However, with the present invention, because the smoke molecules are relatively heavy, it less likely that they will rise into the ambient after the surrounding air temperature reaches the ambient temperature.

In a preferred embodiment, the apparatus includes a cooler housing that forms the chamber, forms a smoke inlet for receiving the smoke and forms the outlet. The chamber includes at least upper and lower chambers separated by a horizontal upper floor, the upper floor forming an upper floor opening between the upper and lower chambers, the housing forming at least one air inlet opening into the upper chamber and the smoke inlet opening into the lower chamber. The cold gas pocket is formed at least partially in the lower chamber so that smoke is cooled in the lower chamber prior to passing through the outlet.

Preferably, the upper chamber is a top chamber, the upper floor is a top floor and the upper floor opening is a top floor opening, the lower chamber includes both a middle chamber and a bottom chamber separated by a horizontal bottom floor, the top floor forming the top floor opening between the top and middle chambers and the bottom floor forming a bottom floor opening between the middle and bottom chambers. Here, the gas pocket is formed at least partially in the bottom chamber and the smoke inlet opens into the bottom chamber.

In one aspect, the chambers have a width and a length and the housing includes a vertical front wall and an opposing back wall, two opposing lateral walls traversing the distance between the front and back walls and perpendicular thereto, and a horizontal top wall and an opposing bottom wall that traverse the distance between the front and back walls. Each of the top and bottom floor openings are formed adjacent the front wall and have a width parallel to the chamber width that is less than the chamber width and a length parallel to the chamber length that is less than the chamber length. The top and bottom floor openings are formed so as to be horizontally misaligned. The housing also includes a first vertical separator wall positioned between the top and bottom floors and separating the top and bottom floor openings. The first separator wall extends from the front wall toward the back wall along a portion of the middle chamber length. The back wall forms the smoke inlet opening into the bottom chamber.

In another aspect, the top floor opening is centrally located along the width of the top chamber, the bottom floor opening includes first and second bottom floor openings, the bottom floor openings horizontally separated and located on either side of the top floor opening so as to be misaligned therewith, and the cooler further includes a second vertical separator wall. The first separator wall separates the top floor opening from the first bottom floor opening and the second separator wall separates the top floor opening from the second bottom floor opening. The second separator wall extends from the front wall toward the back wall along a portion of the middle chamber length.

Also, preferably, the front wall forms the outlet centrally along the width of the bottom chamber and the bottom wall openings are horizontally misaligned with the outlet and the cooler further includes third and fourth vertical separator walls that extend between the bottom wall and the bottom floor. The third separator wall separates the first bottom wall opening from the outlet and the fourth separator wall separates the second bottom wall opening from the outlet, the third and fourth separator walls extend from the front wall toward the back wall along a portion of the bottom chamber length.

In addition, preferably, the apparatus further includes fifth and sixth vertical separator walls between the top wall and the top floor. The fifth separator wall is positioned on one side of the top floor opening and the sixth separator wall is positioned on the other side of the top floor opening. Both of the fifth and sixth vertical walls extend from the front wall toward the back wall along a portion of the top chamber length.

Preferably, all of the separator walls are perpendicular to the front wall.

Another object of the invention is to provide an apparatus that simulates a low lying long lasting fog without causing excessive apparatus vibration and associated noise. As the cold gas and relatively warmer air and the cold air/gas mixture and hot smoke intermix, apparatus walls tend to vibrate like a speaker cone causing excessive and bothersome noise. Where the walls are curved the noise is exacerbated. It has been found that the apparatus noise can be substantially reduced by making the walls perpendicular.

In keeping with the object of minimizing apparatus noise, preferably, all internally exposed surfaces of the cooler walls and floors are covered with a thermally and acoustically insulating layer such as a synthetic or natural rubber or foam such as neoprene. In addition to reducing noise, the insulating layer increases the efficiency of the apparatus by thermally insulating the walls so that the internal cold chambers can maintain extremely low temperatures.

The invention also includes a special effects method for simulating low lying fog which can be used with the apparatus above or some other apparatus. Generally, the method includes the steps of receiving smoke from a smoke generator, reducing the smoke temperature to a temperature below the ambient temperature and providing the cold smoke to the ambient.

The foregoing and other objects and advantages of the invention will be apparent from the following description. In the description reference is made to the accompanying drawings which form a part hereof and in which there is shown, by way of illustration, a preferred embodiment of the invention. The preferred embodiment does not always represent the full scope of the invention, however, and reference must be made therefore to the claims herein for interpreting the scope of the invention.

DESCRIPTION OF THE PREFERRED EMBODIMENT

Figure 1:
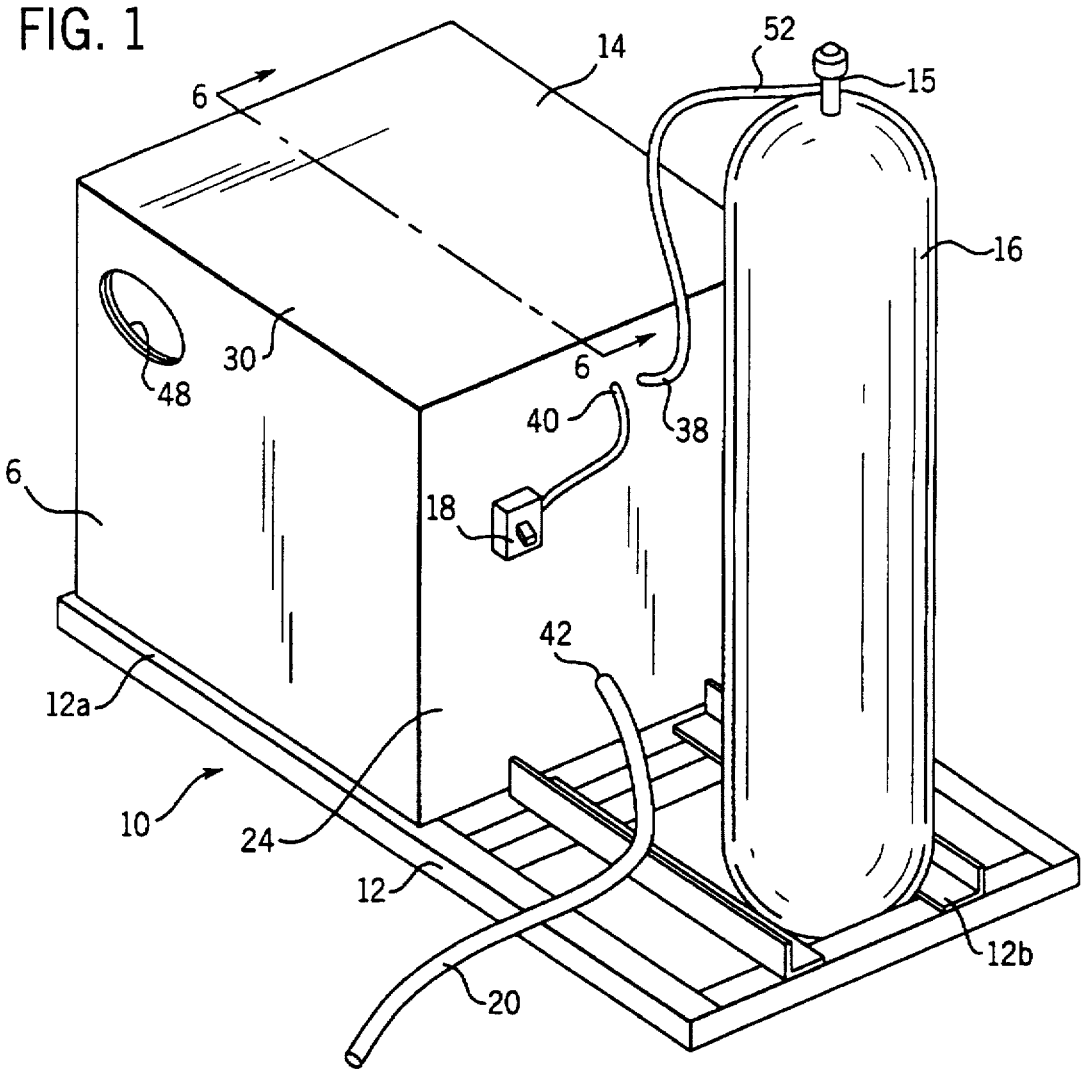
FIG. 1 is a perspective view of a cooling apparatus according to the present invention.

Referring now to FIG. 1, the preferred inventive low-lying fog simulating apparatus 10 includes a chassis 12, a cooler housing 14 which defines a cooler chamber inside, a liquid carbon dioxide tank 16, and a switch 18. In addition, the apparatus 10 includes a hose 20 which is connectable to a smoke generating machine (not shown).

The chassis 12 is formed of a plurality of metal beams which together define a housing receiving area **12*a* and a tank receiving area 12*b* adjacent the housing receiving area 12*a*. While not shown in any of the figures, the chassis 12 may also include means such as brackets or clamps for securely locking the housing 14 and the tank 16 relative to each other and relative to the chassis 12**.

Figure 3:
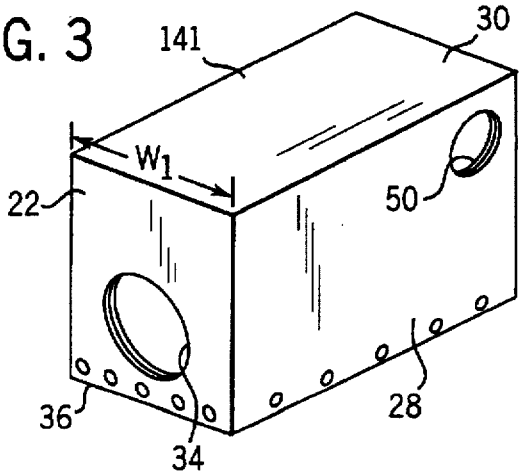
FIG. 3 is a perspective view of a portion of the apparatus shown in FIG. 1.
Figure 2:
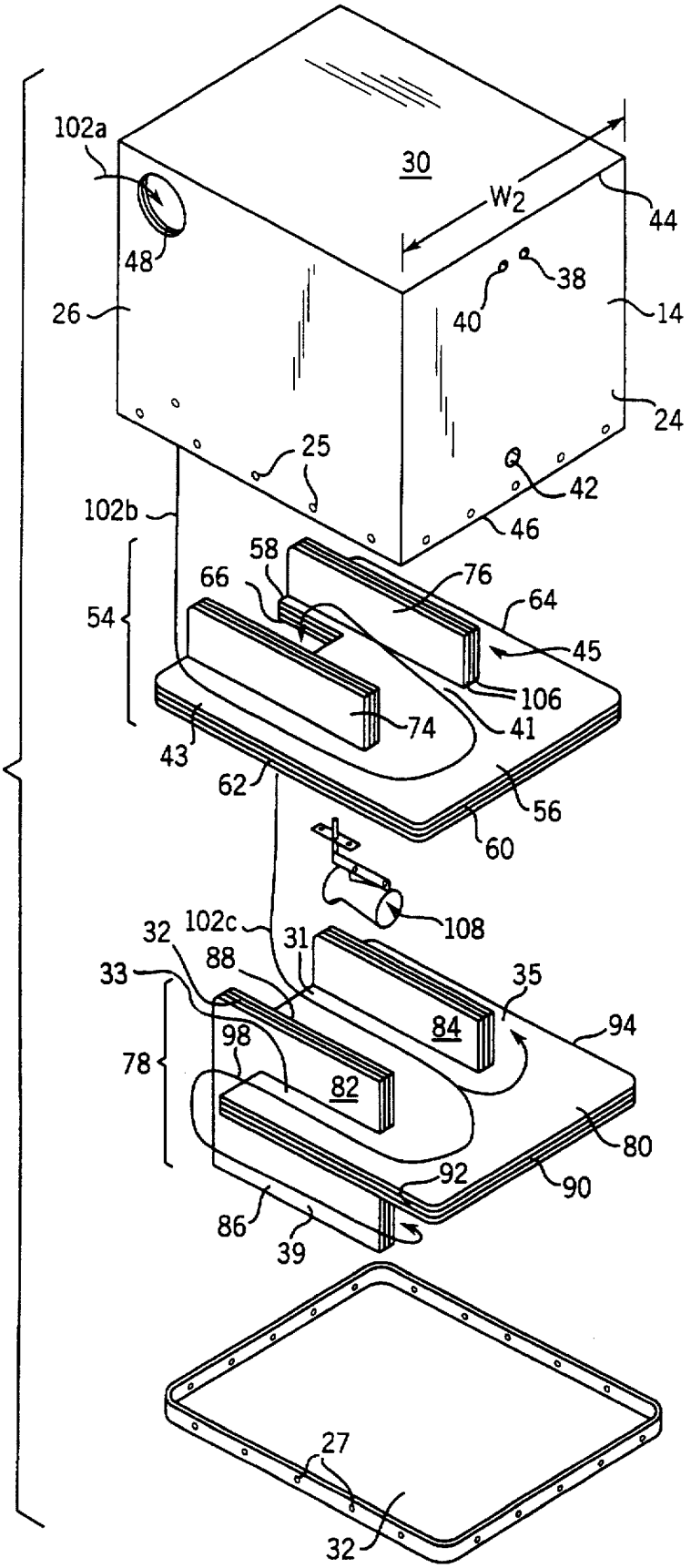
FIG. 2 is an exploded view of a portion of the apparatus shown in FIG. 1.

Referring to FIGS. 1, 2 and 3, the housing 14 includes a front wall 22, a back wall 24 opposite the front wall 22, two opposing lateral walls 26, 28 that traverse the distance between the front and back walls 22, 24 and a top wall 30. The front, back, lateral and top walls 22, 24, 26, 28 and 30 together form a box having an open bottom face. When assembled a bottom plate 32 forms a bottom wall of the box or housing 14.

To attach the bottom plate 32 to the housing 14, a plurality of securing apertures 25 are provided along the lower edges of the front, back and lateral walls 22, 24, 26, 28 and a similarly spaced plurality of apertures 22 are provided along the edges of the plate 32. The apertures 25 and 27 are aligned and screws (not shown) are inserted therethrough to secure the plate 32 to the housing 14.

Preferably, the front, back and lateral walls 22, 24, 26 and 28 form six openings. Referring to FIG. 3, the front wall 22 forms an outlet opening 34 approximately centrally located along a width $W_1$ of the front wall 22 and adjacent a bottom edge 36 thereof. Referring to FIGS. 1 and 2, the back wall 24 forms an inlet 38 adjacent an upper edge 44 of the back wall 24, an electrical inlet 40 adjacent the inlet 38 and a relatively larger smoke inlet 42 approximately centrally located along a width $W_2$ of the back wall 24 a short distance above a lower edge 46. Referring to FIGS. 1, 2 and 3, each of the lateral walls 26, 28 forms a make-up air inlet 48, 50 respectively, in an upper corner adjacent the front wall 22 and top wall 30.

While the switch 18 can be mechanical, in the preferred embodiment, the switch 18 is electrical and is a two-pole single throw switch which can either be on or off so as to turn on or off an electrical valve inside the housing 14 as described in more detail below.

The carbon dioxide tank 16 can either be a high pressure non-refrigerated liquid tank or a low pressure refrigerated liquid tank. Where the tank is a refrigerated low pressure tank, the tank 16 should comprise a large dewar to maintain carbon dioxide in the tank at an extremely cold temperature. A high pressure extension hose 52 is connected to a tank valve 15 at a first end, extends through the inlet 38 and is connected to a nozzle assembly within the housing 14 at a second end as described in more detail below.

Figure 6:
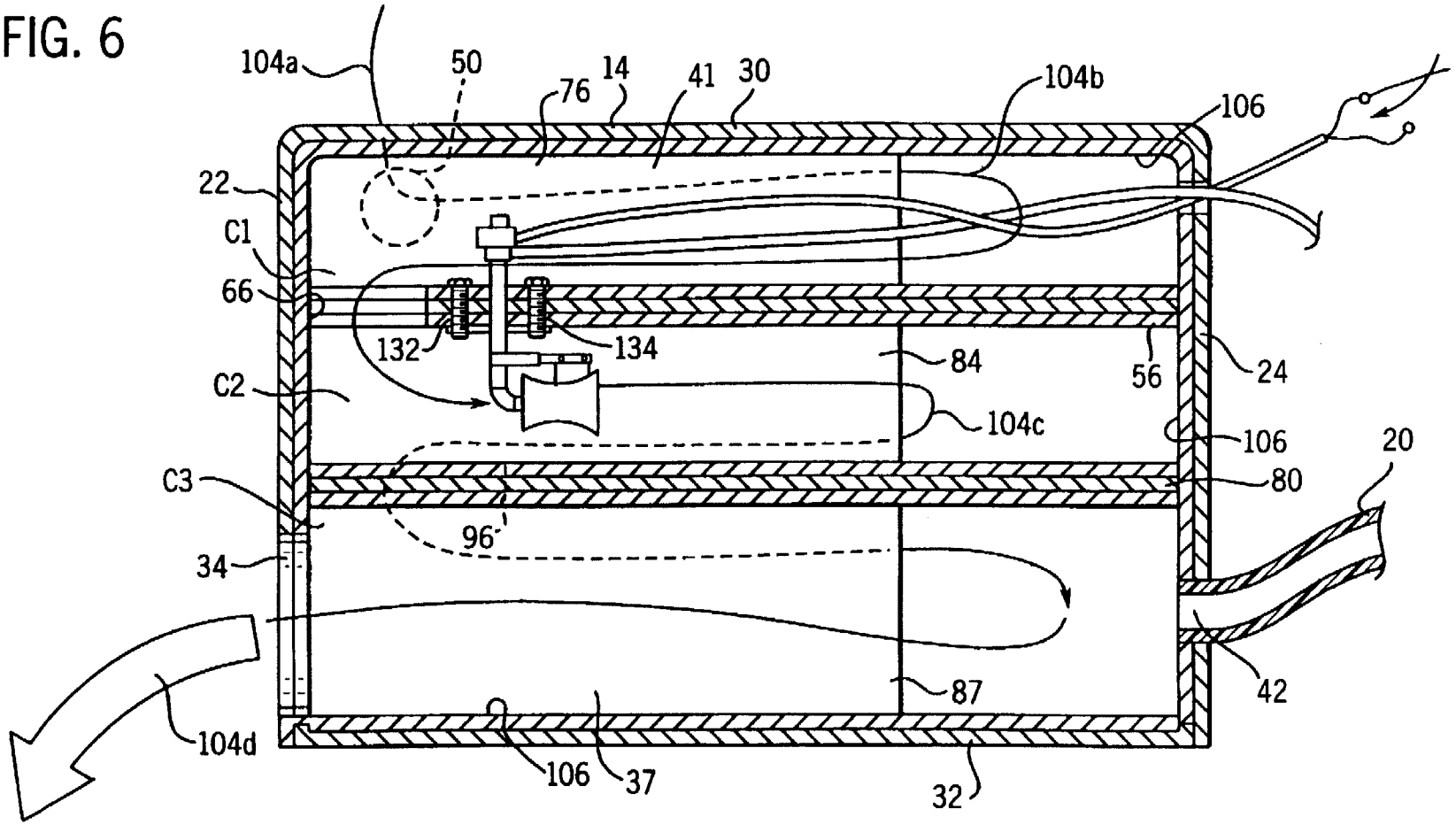
FIG. 6 is a cross-sectional view taken along the line 6—6 of FIG. 1.

Referring to FIGS. 2 and 6, a plurality of floors and separator walls are provided inside the housing 14 which form three separate chambers referred to herein as a top chamber C1, a middle chamber C2 and a bottom chamber C3.

Figure 5A:
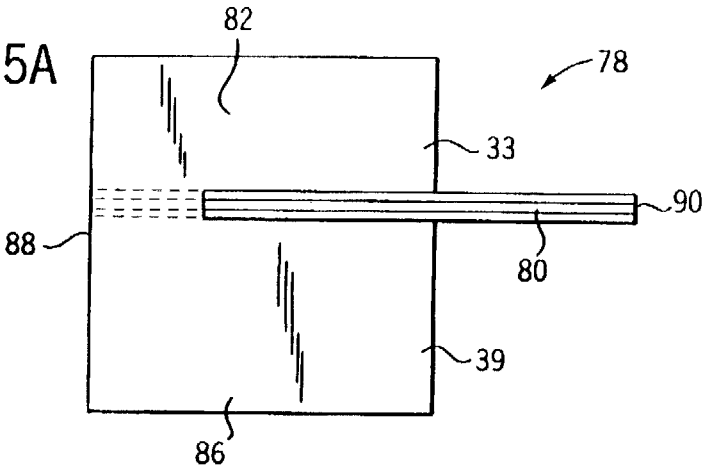
FIG. 5A is a side elevational view of the bottom floor assembly shown in FIG. 2.
Figure 5B:
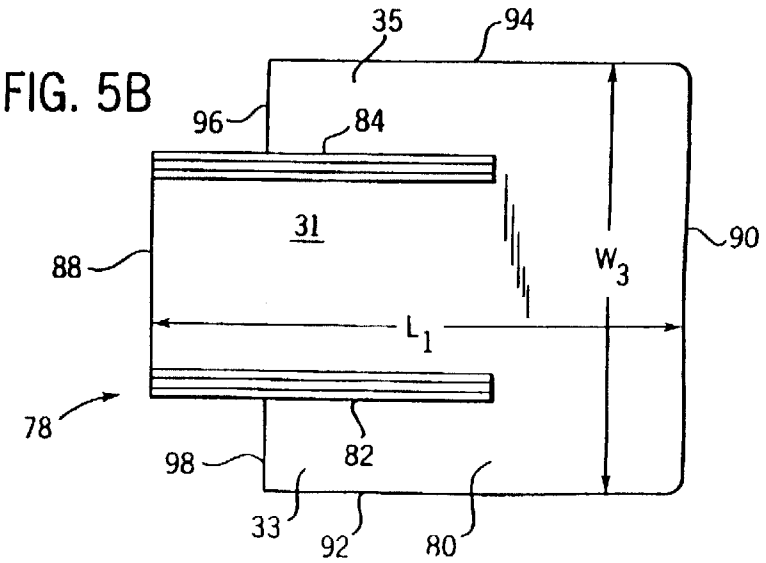
FIG. 5B is a top elevational view of the assembly of FIG. 5A.

Referring also to FIGS. 5A and 5B, a bottom floor assembly 78 includes a bottom floor 80 and first, second, third and fourth separator wall 82, 84, 86 and 87, respectively. The bottom floor 80 is defined by oppositely facing front and back edges 88, 90 and oppositely facing lateral edges 92 and 94, respectively. When positioned inside the housing 14 the bottom floor 80 traverses the distance between the front and back walls 22, 24 and the lateral walls 26 and 28. (See FIG. 6). The bottom floor 80 forms first and second bottom floor openings or recesses 96, 98, the first opening 96 formed at the corner defined by the front edge 88 and one of the lateral edges 94 and the second opening 98 formed at the corner defined by the front edge 88 and the other lateral edge 92. Preferably each of the openings 96, 98 extends slightly less than a quarter of the entire width $W_3$ of the bottom floor 80.

The first and second separator walls 82, 84 extend along a top surface of the lower floor 80 from the front edge 88 toward the back edge 90 but do not extend the entire length $L_1$ of the bottom floor 80. When assembled, the first and second separator walls 82, 84 extend upwardly from a top surface of the bottom floor 80 to the undersurface of a top floor 56 (See FIG. 6).

The third and fourth separator walls 86, 87 extend along a bottom surface of the bottom floor 80 from the front edge 88 toward the back edge 90 of the bottom floor 80, but do not extend the entire length $L_1$ of the bottom floor 80. When assembled, the fifth and sixth separator walls extend from the bottom surface of the bottom floor 80 to bottom plate 32 (See FIG. 6).

The first and second separator walls 82, 84 are spaced apart so that a portion of the first separator wall 82 circumscribes an edge of the second floor opening 98 while a portion of the second separator wall 84 circumscribes an edge of the first bottom floor opening 96. Thus, the first and second separator walls 82, 84 separate openings 96 and 98 and define a central middle chamber 31 therebetween. For the purposes of this explanation, the areas outside the central middle chamber 31 will be referred to as first and second lateral middle chambers 33, 35, respectively.

The third and fourth separator walls 86, 87 are vertically aligned with the first and second separator walls 82, 84 and therefore circumscribe openings 98 and 96, respectively, and define a central bottom chamber 37 and first 39 and second (not shown) lateral bottom chambers. The outlet 34 opens into the central bottom chamber 37.

Referring now to FIGS. 2, 4A, 4B and 6, a top floor apparatus 54 includes the substantially horizontal top floor 56 formed so as to traverse the distance between the front and back walls 22, 24 respectively, and traverse the distance between the two lateral walls 26, 28 when assembled (see FIG. 6). The top floor 56 is defined by a front edge 58 and an oppositely facing back edge 60 and two oppositely facing lateral edges 62, 64. The distance between the two lateral edges 62, 64 defines a top floor width $W_4$ and the distance between the front and back edges 58, 60 defines a top floor length $L_2$. The top floor 56 forms a top floor opening or recess 66 centrally along its front edge 58 which is preferably slightly greater than one third the entire top floor width $W_4$. Adjacent the top floor opening 66, the top floor 56 forms a nozzle aperture 68 centrally along its width $W_4$ and two securing apertures 70, 72, one on either side of the nozzle aperture 68, the securing apertures 70, 72 also preferably centrally located along the top floor width $W_4$.

The top floor assembly 54 also includes fifth and sixth vertical separator walls 74, 76, respectively, which extend from the top floor front edge 58 toward the top floor back edge 60 but do not extend the entire top floor length $L_2$. When assembled, the fifth and sixth separator walls 74, 76 extend up to and contact an under surface of the top wall 30 (See FIG. 6).

The fifth and sixth separator walls 74, 76 are positioned on opposite sides of the top floor opening 66 so that they form a central top chamber 41 and first and second lateral top chambers 43, 45, respectively.

Referring to FIGS. 2, 4A, 4B, 5A, 5B and 6, when assembled, the air intake holes 48, 50 open into the lateral top chambers 43, 45, respectively, electrical 40 and gas 38 inlets open into the top chamber C1, the smoke inlet 42 opens exclusively into the bottom chamber C3, and the outlet 34 opens exclusively into the central bottom chamber 37.

When the apparatus is assembled, two distinct paths through the apparatus are defined. A first path draws air through intake hole 48 along arrow **102*a*. The path continues along arrow 102*b* through the first lateral top chamber 43 and wraps around the fifth separator wall 74, passes through the central top chamber 41 and passes through the top floor opening 66 down into the central middle chamber 31. In the middle chamber C2, the path continues along arrow 102*c* passing around the first separator wall 82 through the first lateral middle chamber 33, down through the bottom floor opening 98 and into the first lateral bottom chamber 39. In the bottom chamber C3, continuing along arrow 102*c*, the path wraps around the third separator wall 86, passes through the central bottom chamber 37 and passes out outlet 34** to the ambient.

The second path through the cooler is similar to the first path except that it occurs on the opposite side of the housing 14. Referring to FIGS. 2, 4A, 4B, 5A, 5B and 6, in this case, following arrow **104*a*, the path comes in through intake hole 50 into the second lateral top chamber 45, wraps around the sixth separator wall 76 at 104*b*, passes between the fifth and sixth separator walls 74, 76 through the central top chamber 41, passes through the top floor opening 66 and into the central middle chamber 31 along arrow 104*c*. In the middle chamber C2 the second path passes between separator walls 82 and 84, wraps around the second separator wall 84 into the second lateral middle chamber 35, passes through bottom floor opening 96 and into the second lateral bottom chamber (see dotted portion of path in bottom chamber C3 of FIG. 6), wraps around the fourth separator wall 87, passes between the fifth and sixth separator walls 86, 87 through the central bottom chamber 37 and passes out of outlet 34 along arrow 104*d***.

In a preferred embodiment all of the internal surfaces of all walls and floors inside the housing 14 are covered with a layer of insulating material. Preferably, the insulating material is both thermally and acoustically insulating and is between 1/16 of an inch and 1 inch thick. Most preferably, the layer is approximately ½ inch thick and is formed of a synthetic or natural rubber or foam such as neoprene. Thus, as can best be seen in FIG. 2, both sides of each separator wall 74, 76 82, 84 and 86 and both the upper and lower surfaces of floors 56, 80 are covered with an insulating layer 106. In addition, all of the internal surfaces of walls 22, 24, 26, 28, 30 and plate 32 are covered with the insulating layer 106 (See FIG. 6). This insulating layer not only contributes to the efficiency of the apparatus by keeping the internal chambers cold, but it also reduces the noise generated by the apparatus as it reduces vibrating and, to the extent that vibrating occurs, reduces noise amplification.

Figure 7A:
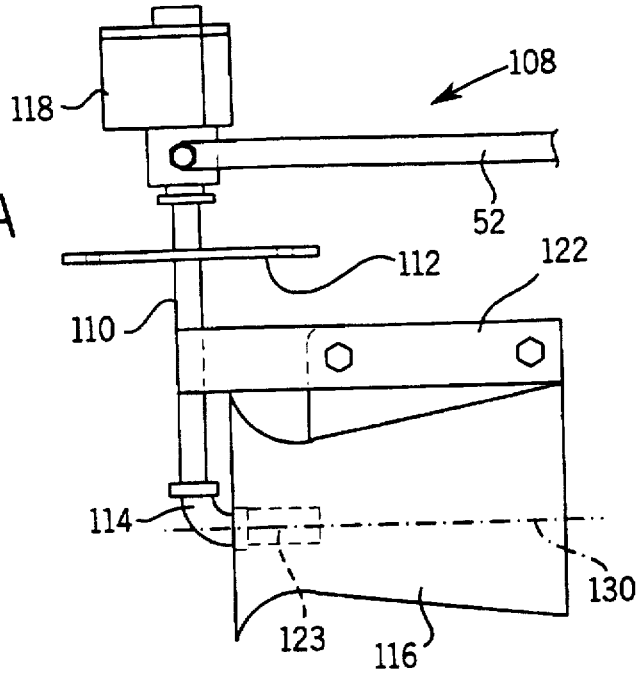
FIG. 7A is a side elevational view of the nozzle assembly as shown in FIG. 2.
Figure 7B:
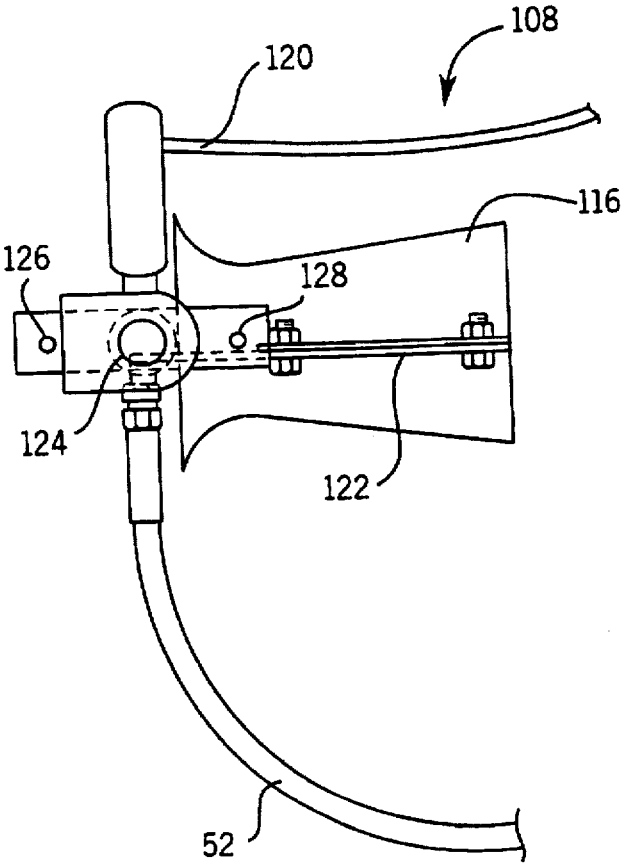
FIG. 7B is a top elevational view of the assembly of FIG. 7A.
Figure 8:
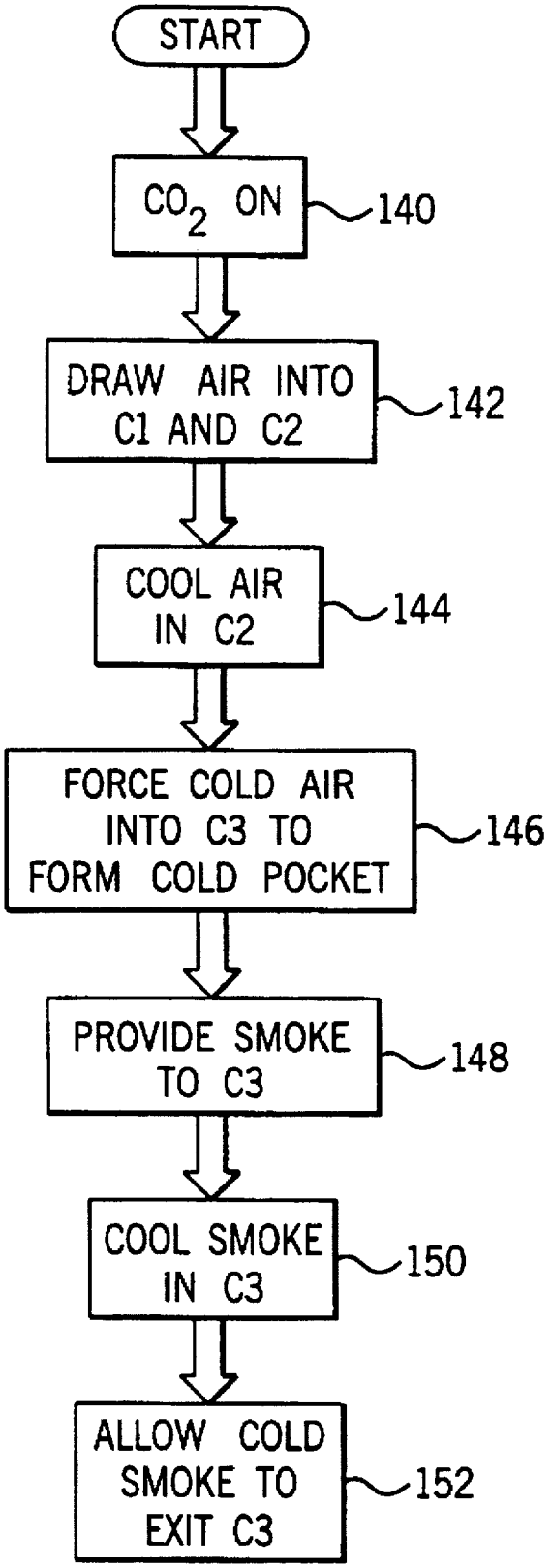
FIG. 8 is a flow chart of an inventive method.

Referring now to FIG. 2, a nozzle assembly 108 is securely connected to a bottom surface of the top floor 56 between the top and bottom floors 56, 80, respectively, within the central middle chamber passage 31. Referring also to FIGS. 7A and 7B, the nozzle assembly includes an elongated pipe 110, a bracket 112, an elbow pipe 114, a venturi 116, an electrically activated valve 118, an activation wire 120, a venturi bracket 122, and a nozzle 123. The bracket 112 forms a central aperture 124 through which the elongated pipe 110 extends and in which the elongated pipe 114 is securely connected. The bracket 112 also forms two securing apertures 126, 128, one on either side of the central aperture 124.

The electrically activated valve 118 is secured at the top of the pipe 110 and the elbow pipe 114 is secure at the bottom of the pipe 110. The nozzle 123 is connected to the elbow pipe 114 and therefore, it is directed along an axis 130 which is perpendicular to the length of the pipe 110. The venturi bracket 122 is connected between bracket 112 and elbow pipe 114 and extends perpendicular to pipe 110, holding the venturi 116 so that it surrounds and is concentric with the nozzle 123. Referring also to FIG. 1, the hose 52 which enters the housing 14 through inlet 38 is connected to the valve 110. The activation wire 120 which leads from switch 18 is connected to the valve 118 as well known in the art. Thus, when the switch 18 is turned on, the valve 118 is opened and liquid from within tank 16 passes through hose 52 and the valve 118, through pipes 110 and 114 and is forced out of the nozzle 123. The nozzle 123 atomizes the liquid and forms a cold gas pocket in the central middle chamber 31.

Figure 4A:
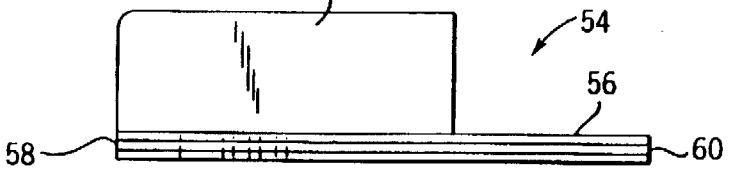
FIG. 4A is a side elevational view of the top floor assembly shown in FIG. 2.
Figure 4B:
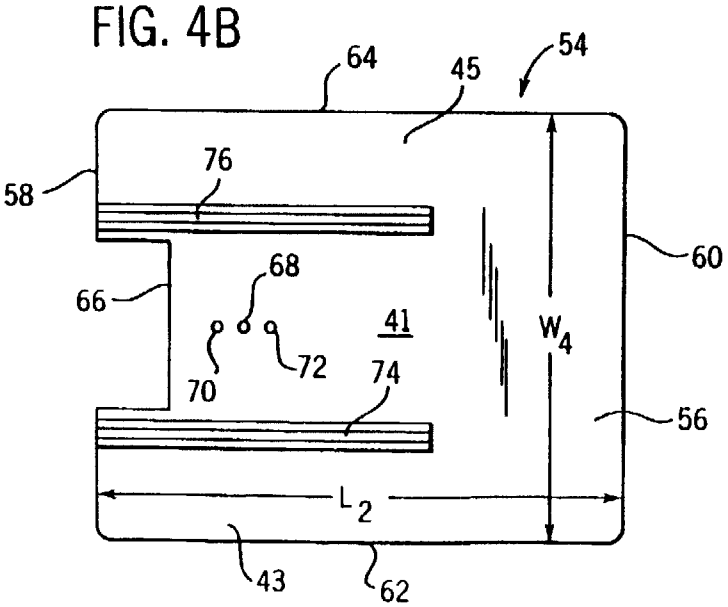
FIG. 4B is a top elevational view of the assembly of FIG. 4A.

Referring to FIGS. 2, 4B and 6, the nozzle assembly 108 is connected to the bottom surface of the top floor 56 via two securing bolts 132, 134 which extend through apertures 126, 128 and through apertures 70, 72. When so secured, the elongated pipe 110 extends through nozzle aperture 68 and the valve 118 is located in the top chamber C1 while portions of the nozzle assembly 108 below bracket 112 are located in the central middle chamber passage 31.

Referring to FIGS. 1, 2, 4A, 4B, 5A, 5B, 6 and 7, to provide low lying smoke which simulates low lying fog, the first step is to turn on the liquid carbon dioxide source at process step 140. To this end, an operator switches on switch 18 which opens valve 118 and provides carbon dioxide through hose 52, pipes 110 and 114 to the nozzle 123. Carbon dioxide forced into the nozzle 123 is atomized and expands in the venturi and the cold gaseous carbon dioxide is forced out of the venturi along axis 130 toward the back wall 24 of the housing 14. The nozzle 123 and venturi 116 operate together to provide a vacuum within the central middle chamber 31 adjacent the front wall 22. This vacuum sucks air along paths 102*a* and 104*a* from the intake holes 48, 50, through the first and second lateral top chambers 43, 45, through the central top chamber 41 and through the top floor opening 66 according to process step 142. At step 144, the air which is sucked in via the venturi 116 is cooled in the central middle chamber 31 and then forced via the nozzle 123 and venturi 116 toward the back wall 24 and around the first and second separator walls 82, 84. At step 146 the cold air/$CO_2$ mixture is forced down through the bottom floor openings 96, 98 into the first 39 and second (not shown) lateral bottom chambers and eventually into the central bottom chamber 37 and provides an extremely cold bottom chamber C3. Experiments have shown that the temperature within the middle and bottom chambers C2, C3 can be reduced to less then −90° F.

Next, at step 148 the smoke machine (not shown) is turned on which provides smoke via hose 20 and aperture 42 to the bottom chamber C3. At step 150, the smoke is cooled in the bottom chamber C3 and, at step 152, after the smoke is cooled, the smoke is passed out of outlet 34 and into the ambient.

Where the preferred smoke is used with the inventive apparatus, not only is the smoke cooled, but it is believed that smoke molecule characteristics are advantageously altered. For example, when the smoke fluid that is sold under the trademark LSX by LeMaitre Special Effects is used to generate the smoke, the molecular weight of the smoke molecules is believed to be increased when the smoke is cooled using carbon dioxide. In addition, when the LSX smoke fluid is used, when the smoke molecules are cooled, it is believed that the speed of the electrons within the molecule is reduced such that the molecules become magnetically attracted to the earth's surface. Both of these molecule changes advantageously enhance the low lying characteristics of the resulting smoke.

Once the smoke has been distributed into the ambient, because the smoke and gas mixed therewith is extremely cold, the smoke and cold gas react with the relatively warmer ambient and form a cold thermal down-draft which forces the smoke toward the earth's surface where the smoke hovers causing a low lying fog effect.

It should be noted that certain of the dimensions of the inventive apparatus are important for proper operation of the apparatus. For example, the intake holds 48, 50 must be of a certain size to ensure that a proper amount of air is provided to the apparatus. Where too little air is provided, the smoke will not cool sufficiently as it passes through the central lower chamber 37 and when the smoke is dispersed into the ambient, the required cold air down draft will not be produced. In this case an undesirable smoke haze may result. However, where too much air is provided, the outlet 34 and other portions of the central lower chamber passage 37 can become frosted as moisture within the air condenses and accumulates thereon. The proper size of the intake holes depend on the ambient temperature and humidity. Therefore, it might be advantageous to provide a means to vary the size of the intake holes (e.g. a variable position sliding door) so that a user can alter the volume of intake air as a function of apparatus operation.

Another dimension that is important is the length of the central lower chamber 37. Clearly this passage has to be constructed so that it is long enough to, given the temperature of the cold air/$CO_2$ therein and the initial temperature of the smoke, be able to cool the smoke to a necessary cold temperature. Preferably, the smoke dispersed to the ambient will have a temperature below 0° F. and most preferably below −25° F. The central lower chamber 37 should be dimensioned such that this limitation is met.

It should be understood that the methods and apparatuses described above are only examples and do not limit the scope of the invention, and that various modifications could be made by those skilled in the art that fall under the scope of the invention. For example, while, preferably, the inventive apparatus is used with a specific type of smoke generating liquid, clearly, the present invention could be used with many different types of smoke liquids. In its broadest sense, the important inventive limitation is that smoke is cooled using liquid carbon dioxide prior to dispersing the smoke into the ambient.

Moreover, while the present invention is described as having three different chambers (i.e. top, middle and bottom), clearly, the present invention could be practiced with less than three chamber or with a cooler having more than three chambers. Note, however, that in this regard it has been found that the three chamber structure has certain advantages. For example, the three chamber structure allows air to be sucked in through one chamber, allows air cooling in a central most insulated chamber, and allows smoke cooling in a separate lower chamber. Moreover, forming the bottom floor openings 96 and 98 opposite the smoke inlet 42 is advantageous. Here, because the smoke is initially hot when it enters the housing 14, it will naturally tend to rise within the housing 14. However, with the preferred apparatus as described above the smoke is contained by the bottom floor 80 and never reaches the bottom floor openings 96, 98. Thus, all smoke is forced out outlet 34. Furthermore, while it is desirable to have an insulating layer on all internal surfaces of the cooler, clearly, where noise is not a factor or is less of a factor, either some or all of the internal surfaces of the cooler may be provided without insulation.

In addition, it has been found that providing three chambers arranged as described above reduces the noise generated by the inventive apparatus.

Furthermore, there may be more than a single smoke inlet or a single outlet and, there may be more than two make-up air inlet holes. To apprise the public of the scope of this invention, I make the following claims.

I claim:

1. A special effects apparatus for simulating low lying fog in an environment characterized by an ambient temperature, the apparatus to be used with a smoke generator that provides smoke to the apparatus, the apparatus comprising:

a housing forming a chamber having a smoke inlet and an outlet, the housing connectable to the smoke generator for providing smoke through the inlet which passes through the chamber prior to passing through the outlet into the ambient;

a liquid carbon dioxide source; and an expansion valve positioned in the chamber and connected to the source for expanding the liquid carbon dioxide into a cold gaseous carbon dioxide forming a cold gas pocket within the chamber for reducing the temperature of the smoke to a temperature below the ambient temperature prior to the smoke passing through the outlet.

2. The apparatus of claim 1 wherein the valve is a nozzle surrounded by a venturi.

3. The apparatus of claim 1 wherein the carbon dioxide source is a high pressure source.

4. The apparatus of claim 1 wherein the smoke is cooled to a temperature less than 0 degrees F. prior to passing through the outlet.

5. The apparatus of claim 1 wherein the smoke is cooled to a temperature less than −10 degrees F. prior to passing through the outlet.

6. The apparatus of claim 1 wherein the chamber includes at least upper and lower chambers separated by a horizontal upper floor, the upper floor forming an upper floor opening between the upper and lower chamber, the housing forming at least one air inlet opening into the upper chamber and the smoke inlet opening into the lower chamber, the gas pocket formed at least in part in the lower chamber.

7. The apparatus of claim 6 wherein the air inlet includes two air inlets, each of the lateral walls forming a unique air inlet, each air inlet formed adjacent the front and top walls.

8. The apparatus of claim 6 wherein the upper chamber is a top chamber, the upper floor is a top floor and the upper floor opening is a top floor opening, the lower chamber includes both a middle chamber and a bottom chamber separated by a horizontal bottom floor, the top floor forming the top floor opening between the top and middle chambers and the bottom floor forming a bottom floor opening between the middle and bottom chambers, the gas pocket formed at least partially in the bottom chamber and the smoke inlet opening into the bottom chamber.

9. The apparatus of claim 8 wherein the carbon dioxide source is a low pressure refrigerated source.

10. The apparatus of claim 8 wherein the chambers have a width and a length and the housing includes a vertical front wall and an opposing parallel back wall, two opposing lateral walls traversing the distance between the front and back walls and perpendicular thereto, and a horizontal top wall and an opposing bottom wall that traverse the distance between the front and back walls and are perpendicular to the front and back walls and to the lateral walls, each of the top and bottom floor openings formed adjacent the front wall and having a width parallel to the chamber width that is less than the chamber width and a length parallel to the chamber length that is less than the chamber length, the top and bottom floor openings formed so as to be vertically misaligned, the housing also including a first vertical separator wall positioned between the top and bottom floors and separating the top and bottom floor openings, the first separator wall extending from the front wall toward the back wall along a portion of the middle chamber length, the back wall forming the smoke inlet opening into the bottom chamber.

11. The apparatus of claim 10 wherein the top floor opening is centrally located along the width of the top chamber, the bottom floor opening includes first and second bottom floor openings, the bottom floor openings horizontally separated and located on either side of the top floor opening so as to be vertically misaligned therewith, and the cooler further includes a second vertical separator wall, the first separator wall horizontally spaced between the top and first bottom floor openings and the second separator wall horizontally spaced between the top and the second bottom floor openings, the second separator wall extending from the front wall toward the back wall along a portion of the middle chamber length.

12. The apparatus of claim 11 wherein the front wall forms the outlet centrally along the width of the bottom chamber and the bottom floor openings are vertically misaligned with the outlet and the cooler further includes third and fourth vertical separator walls that extend between the bottom wall and the bottom floor, the third separator wall separating the first bottom wall opening from the outlet and the fourth separator wall separating the second bottom wall opening from the outlet, the third and fourth separator walls extending from the front wall toward the back wall along a portion of the bottom chamber length.

13. The apparatus of claim 12 wherein the cooler further includes fifth and sixth vertical separator walls between the top wall and the top floor, the fifth separator wall positioned on one side of the top floor opening and the sixth separator wall positioned on the other side of the top floor opening, both of the fifth and sixth vertical walls extending from the front wall toward the back wall along a portion of the top chamber length.

14. The apparatus of claim 13 wherein all of the separator walls are perpendicular to the front wall.

15. The apparatus of claim 13 wherein all internally exposed surfaces of the cooler walls and floors are covered with an insulating layer.

16. The apparatus of claim 15 wherein the insulating layer is formed of a thermally and acoustically insulating material.

17. The apparatus of claim 16 wherein the material is neoprene.

18. A special effects method for simulating low lying fog in an environment characterized by an ambient temperature, the method to be used with a smoke generator that provides smoke and a liquid carbon dioxide source, the method comprising the steps of:

receiving smoke from the smoke generator;

expanding the liquid carbon dioxide into a cold carbon dioxide gas to form a cold gaseous pocket;

passing the smoke through the cold gaseous pocket to reduce the smoke temperature to a temperature below the ambient temperature; and providing the cold smoke to the ambient.

19. The method of claim 18 wherein the step of passing includes the step of reducing the smoke temperature to less than 0 degrees F.

20. The method of claim 19 wherein the step of reducing the smoke temperature includes the step of reducing the smoke temperature to less than −10 degrees F.

21. The method of claim 20 wherein the step of reducing the smoke temperature includes the step of reducing the smoke temperature to less than −25 degrees F.

* * * * *